US012703599B2

(12) United States Patent
Keeney et al.

(10) Patent No.: US 12,703,599 B2
(45) Date of Patent: Aug. 11, 2026

(54) APPARATUS AND METHOD FOR MANAGING CRAFT SUPPLIES

(71) Applicant: LEMONWOOD INC., Tucson, AZ (US)

(72) Inventors: Colm Keeney, Tucson, AZ (US); Veronica Van, Tucson, AZ (US)

(73) Assignee: Lemonwood Inc., Tucson, AZ (US)

( * ) Notice: Subject to any disclaimer, the term of this patent is extended or adjusted under 35 U.S.C. 154(b) by 25 days.

(21) Appl. No.: 18/786,468

(22) Filed: Jul. 27, 2024

(65) Prior Publication Data

US 2025/0042689 A1 Feb. 6, 2025

Related U.S. Application Data

(60) Provisional application No. 63/529,897, filed on Jul. 31, 2023.

(51) Int. Cl.
*B65H 49/38* (2006.01)

(52) U.S. Cl.
CPC ..... *B65H 49/38* (2013.01); *B65H 2701/31* (2013.01)

(58) Field of Classification Search
CPC ..... B65H 49/30; B65H 49/38; B65H 75/22; B65H 2701/31
See application file for complete search history.

(56) References Cited

U.S. PATENT DOCUMENTS

| | | | | |
|---|---|---|---|---|
| 5,975,458 | A * | 11/1999 | Goldthreate | D04B 3/06 242/603 |
| 6,305,637 | B1 * | 10/2001 | Back | B65H 49/28 242/127 |
| 7,343,647 | B1 * | 3/2008 | Kinskey | A45F 5/00 224/268 |
| 9,993,122 | B2 * | 6/2018 | Bowen | A47K 10/3836 |
| 2004/0238667 | A1 * | 12/2004 | Clark | B65H 49/28 242/129 |
| 2008/0127461 | A1 * | 6/2008 | Linden | A45F 5/02 24/302 |
| 2009/0212151 | A1 * | 8/2009 | Sepehri | D04B 3/06 242/588.1 |

* cited by examiner

*Primary Examiner* — Sang K Kim
(74) *Attorney, Agent, or Firm* — Womble Bond Dickinson (US) LLP

(57) ABSTRACT

A yarn minder includes a substantially circular base and a connectable spindle. The spindle is substantially flat and is somewhat anchor-shaped, including a head, a shaft, and two arms. The spindle can be inserted through a slot in the circular base and the arms of the spindle will catch on the bottom of the circular base, thereby connecting the spindle to the circular base. With the spindle in place, a crafter can insert the yarn onto the spindle, where the potential for tangling and knotting is greatly reduced. An optional ring and strap may be connected to the head of the spindle with a swivel connection, thereby allowing for greater flexibility in managing the yarn. The swivel connection allows the circular base to freely rotate in a circular motion as the yarn is pulled from the spindle.

15 Claims, 6 Drawing Sheets

APPARATUS AND METHOD FOR MANAGING CRAFT SUPPLIES

BACKGROUND OF THE INVENTION

1. Technical Field

This disclosure generally relates to crafts and hobbies, and more specifically relates to a unique apparatus and method for improving the experience of creating certain hand-crafted fiber arts designs.

2. Background Art

Knitting and crocheting are a favorite pastime or hobby for many people. The ability to take various types of yarn and similar materials and use them create unique custom products is very enticing and fulfilling. A crafter or hobbyist can purchase yarn in one or more forms. For example, hanks, balls, and skeins are various terms to describe a quantity of yarn. While often used interchangeably in the crafting community, there are some differences between the terms.

A skein of yarn refers to a unit of yarn where the yarn has been loosely twisted, wrapped, and wound into a long, oblong shape. A ball of yarn is simply a round conglomeration of loosely wound yarn. The yarn can be pulled from the outside of the ball, and sometimes from the inside as well. A hank is a different way of selling yarn where the yarn is loosely wound into a large ring shape and then twisted on itself to make a simply package that's easy to ship and store.

Regardless of how the yarn is originally sold or provided, once it's time to make an item or object, the yarn is unwound and joined together by the use of hooks or needles. Various objects such as blankets, scarves, sweaters, gloves, stuffed animals can be created from the yarn. While knitting and crocheting can be fun, some aspects of these hobbies can be troublesome, particularly with regards to the dispensing and managing of large quantities of yarn.

One of the most common problems results while working on a project involves keeping the yarn free from getting tangles and knots when the crafter is moving around, walking, or traveling. As a strand of yarn is pulled from the hank, ball, or skein, it can get tangled on itself. If not noticed promptly, the yarn may also form a knot from the pressure of pulling on the yarn. Additionally, the yarn can become tangled and knotted when stored in a bag or box when not being used. This is particularly a problem when traveling because the yarn for an in-process project is usually just placed or packed into a bag and the yarn will often get tangled or knotted during transport, requiring additional work to untangle the yarn when it's time to start working on the project again.

While some kinds of bags and packages have been specifically created to help minimize the tangling and knotting problem, these items are often large and unwieldy, hard to transport, and often simply unsuccessful in achieving the goal. Accordingly, without additional improvements in the state of the art to address problems associated with tangled and knotted yarn associated with moving, walking, or traveling with a project, knitting and crocheting will continue to less enjoyable than might otherwise be possible.

BRIEF SUMMARY OF THE INVENTION

A yarn minder includes a substantially circular base and a selectively connectable spindle. The spindle is substantially flat and is somewhat anchor-shaped, including a head, a shaft, and two arms. The spindle can be inserted through a slot in the circular base. After passing through the slot, the arms of the spindle will catch on the bottom of the circular base, thereby connecting the spindle to the circular base. With the spindle in place, a crafter can insert the yarn onto the spindle, where the potential for tangling and knotting is greatly reduced if not eliminated. An optional ring and strap may be connected to the head of the spindle with a swivel connection, thereby allowing for greater flexibility in managing the yarn. The swivel connection allows the circular base to freely rotate in a circular motion as the yarn is pulled from the spindle. The rotational or spinning movement greatly reduces the potential for tangling and knotting.

The foregoing and other features and advantages will be apparent from the following more particular description, as illustrated in the accompanying drawings.

BRIEF DESCRIPTION OF THE SEVERAL VIEWS OF THE DRAWING(S)

The disclosure will be described in conjunction with the appended drawings, where like designations denote like elements, and:

DETAILED DESCRIPTION OF THE INVENTION

A yarn minder includes a substantially circular base and a selectively connectable spindle. The spindle is substantially flat and is somewhat anchor-shaped, including a head, a shaft, and two arms. The spindle can be inserted through a slot in the circular base. After passing through the slot, the arms of the spindle will catch on the bottom of the circular base, thereby connecting the spindle to the circular base. With the spindle in place, a crafter can insert the yarn onto the spindle, where the potential for tangling and knotting is greatly reduced if not eliminated. An optional ring and strap may be connected to the head of the spindle with a swivel connection, thereby allowing for greater flexibility in managing the yarn. The swivel connection allows the circular base to freely rotate in a circular motion as the yarn is pulled from the spindle. The rotational or spinning movement greatly reduces the potential for tangling and knotting.

Figure 1:
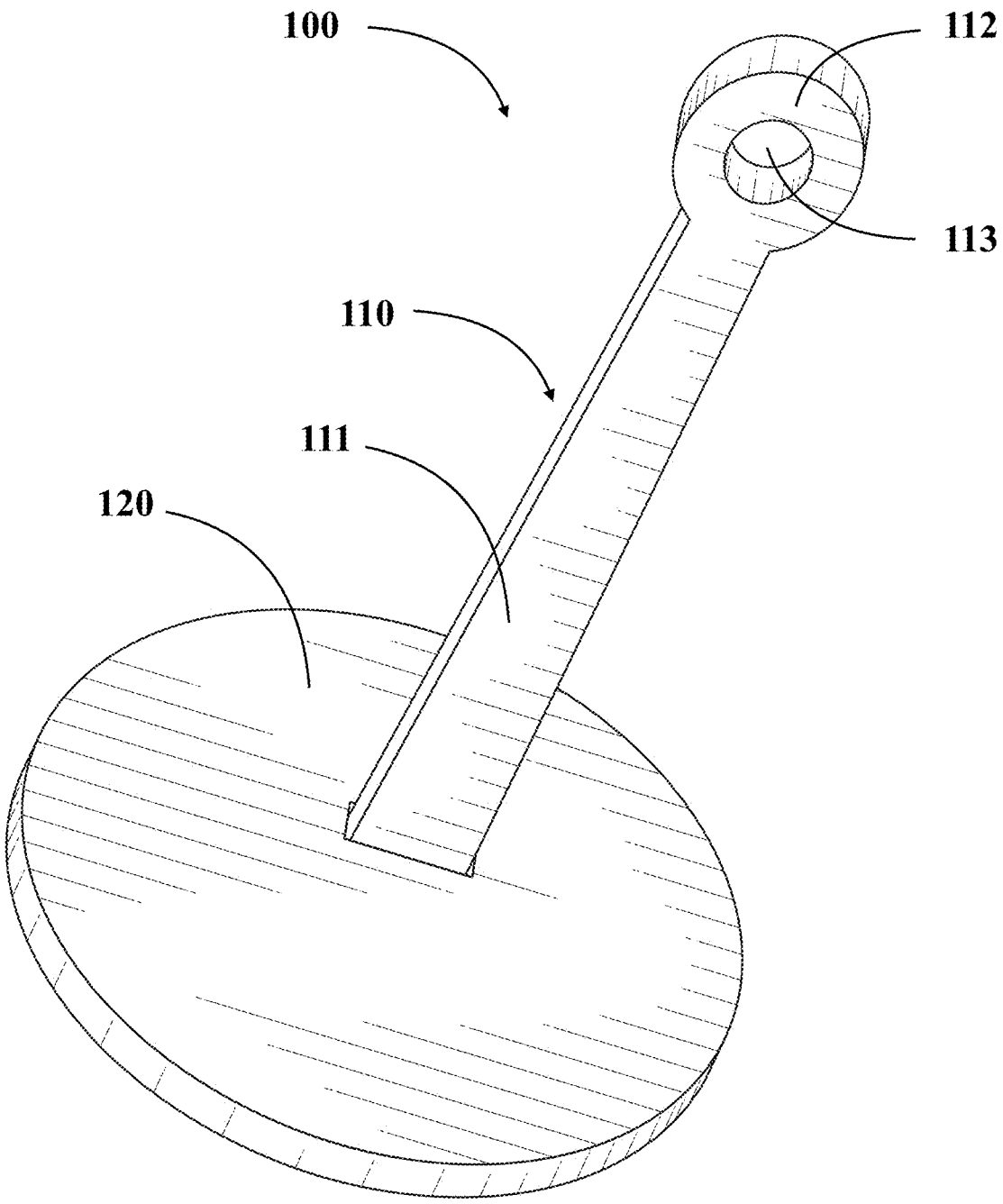
FIG. 1 is a perspective view of a yarn minder apparatus in accordance with a preferred exemplary embodiment of the present invention.

Referring now to FIG. 1, a perspective view of a yarn minder apparatus 100 in accordance with a preferred exemplary embodiment of the present invention is depicted. As shown in FIG. 1, yarn minder 100 comprises a spindle 110 and a substantially circular base 120. In the most preferred embodiments of the present invention, spindle 110 comprises a shaft 111; a head 112, and an aperture 113 formed in head 112.

Figure 2:
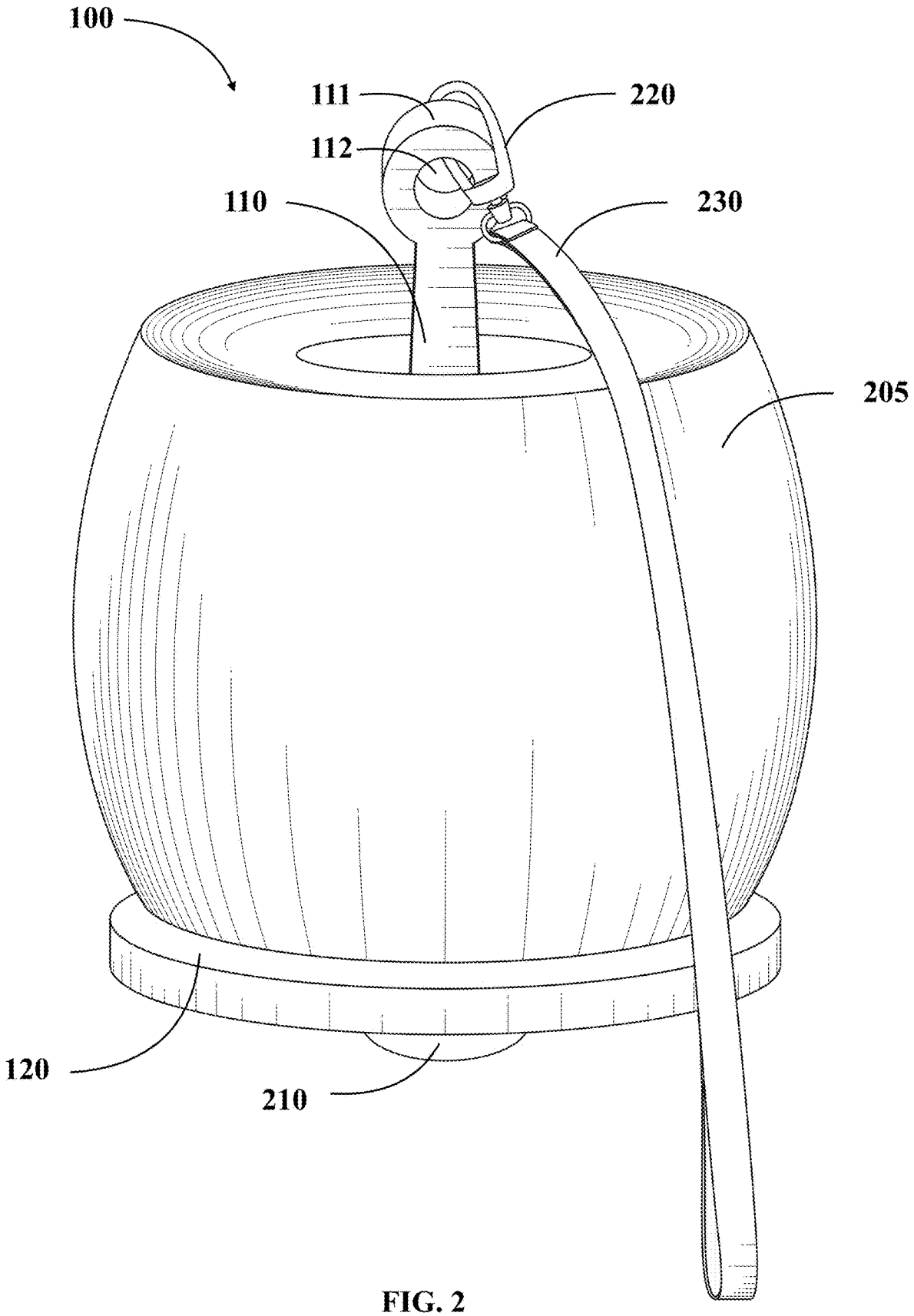
FIG. 2 is a perspective view of a yarn minder apparatus with yarn, a connector, and a strap in accordance with a preferred exemplary embodiment of the present invention.

Referring now to FIG. 2 a perspective view of a yarn minder apparatus with yarn 205, a connector 220, and a strap 230 in accordance with a preferred exemplary embodiment of the present invention is depicted. As shown in FIG. 2, aperture 112 is formed in head 111 and connector 220 is inserted through aperture 112. Strap 230 is connected to connector 220. Strap 230 may be manufactured from any suitable material including wood, leather, plastic, or the like.

In the most preferred embodiments of the present invention, connector 220 is a swivel connector which allows yarn minder 100 to freely rotate in a horizontal plane. The crafter may insert their arm through strap 230 and rest the weight of yarn minder 100 on their wrist. This allows the crafter to have yarn 205 close at hand and to easily dispense yarn 205 from yarn minder 100. The rotational movement is very important because as yarn 205 is gradually removed and used in a project, yarn 205 stays organized without becoming tangled. Further, as shown in FIG. 2, the distal end 210 of spindle 110 extends through base 120 and is supporting base 120.

Figure 3:
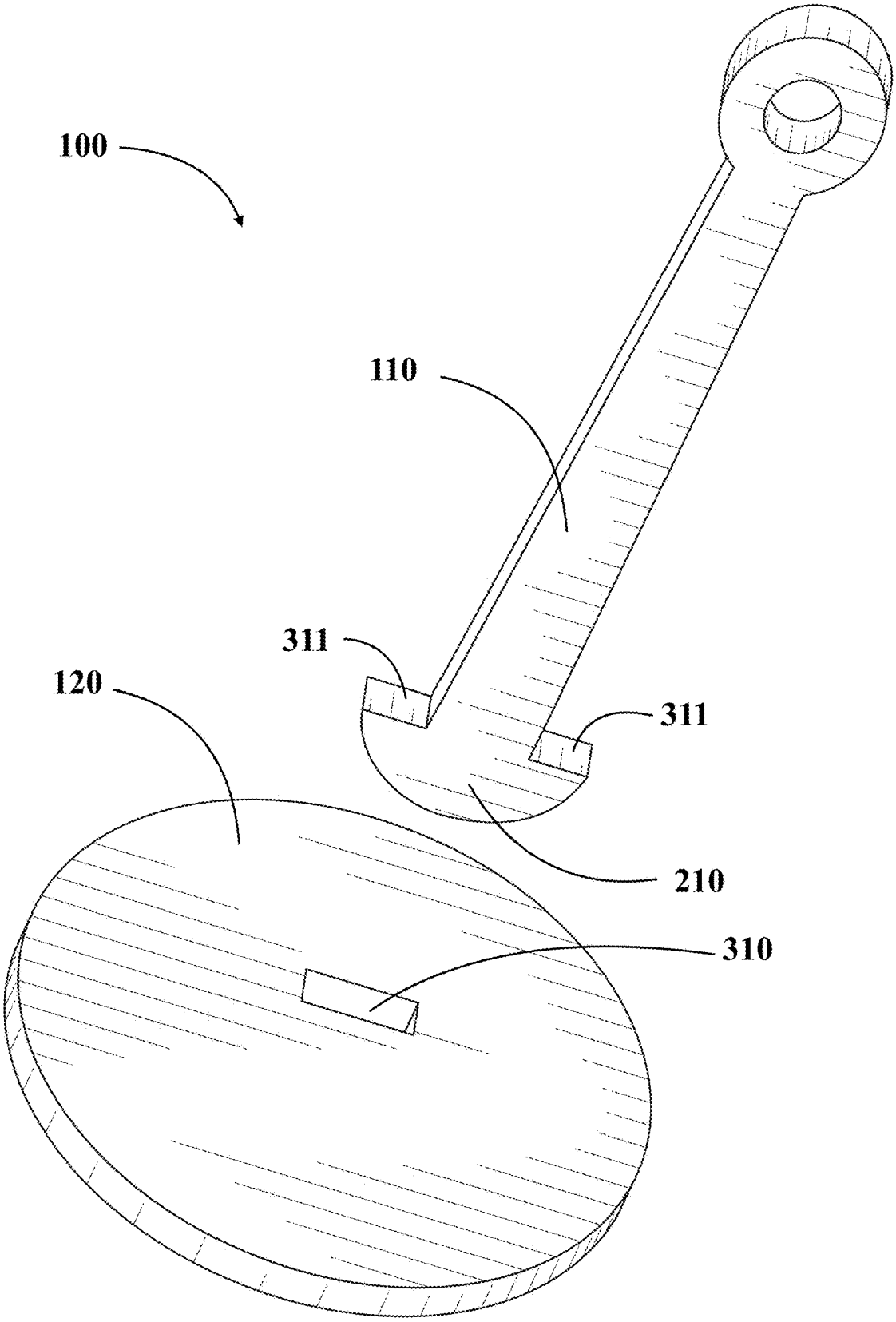
FIG. 3 is a disconnected perspective view of a yarn minder apparatus in accordance with a preferred exemplary embodiment of the present invention.

Referring now to FIG. 3, an exploded perspective view of a yarn minder apparatus in accordance with a preferred exemplary embodiment of the present invention is depicted. As shown in FIG. 3, distal end 210 of spindle 110 is substantially semi-circular in shape and comprises two flat arms 311. Circular base 120 comprises a slot 310. The distance between the most distant edges of arms 311 is greater than the width of slot 301. In practice, spindle 110 can be rotated in a plane perpendicular to the plane formed by base 120. This allows arms 311 to be inserted through slot 310, where arms 311 support base 120.

Figure 4:
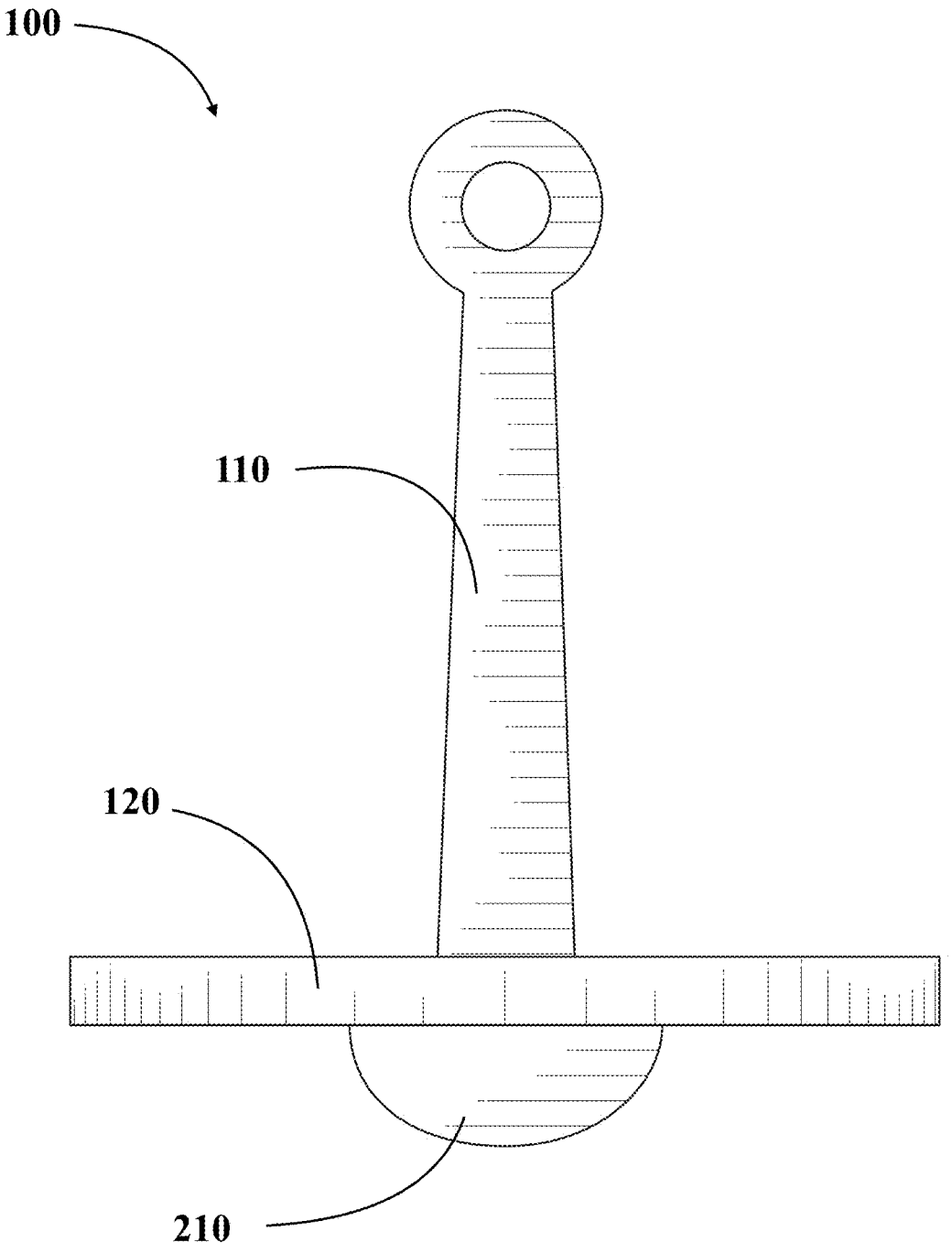
FIG. 4 is a front view of a yarn minder apparatus in accordance with a preferred exemplary embodiment of the present invention.

Referring now to FIG. 4 a front view of a yarn minder apparatus in accordance with a preferred exemplary embodiment of the present invention is depicted. As shown in FIG. 4, distal end 201 of spindle 110 has been inserted through slot 310 and is supporting circular base 120. Circular base 120 is, in turn, supporting any yarn 205 that that been wrapped around spindle 110.

Figure 5:
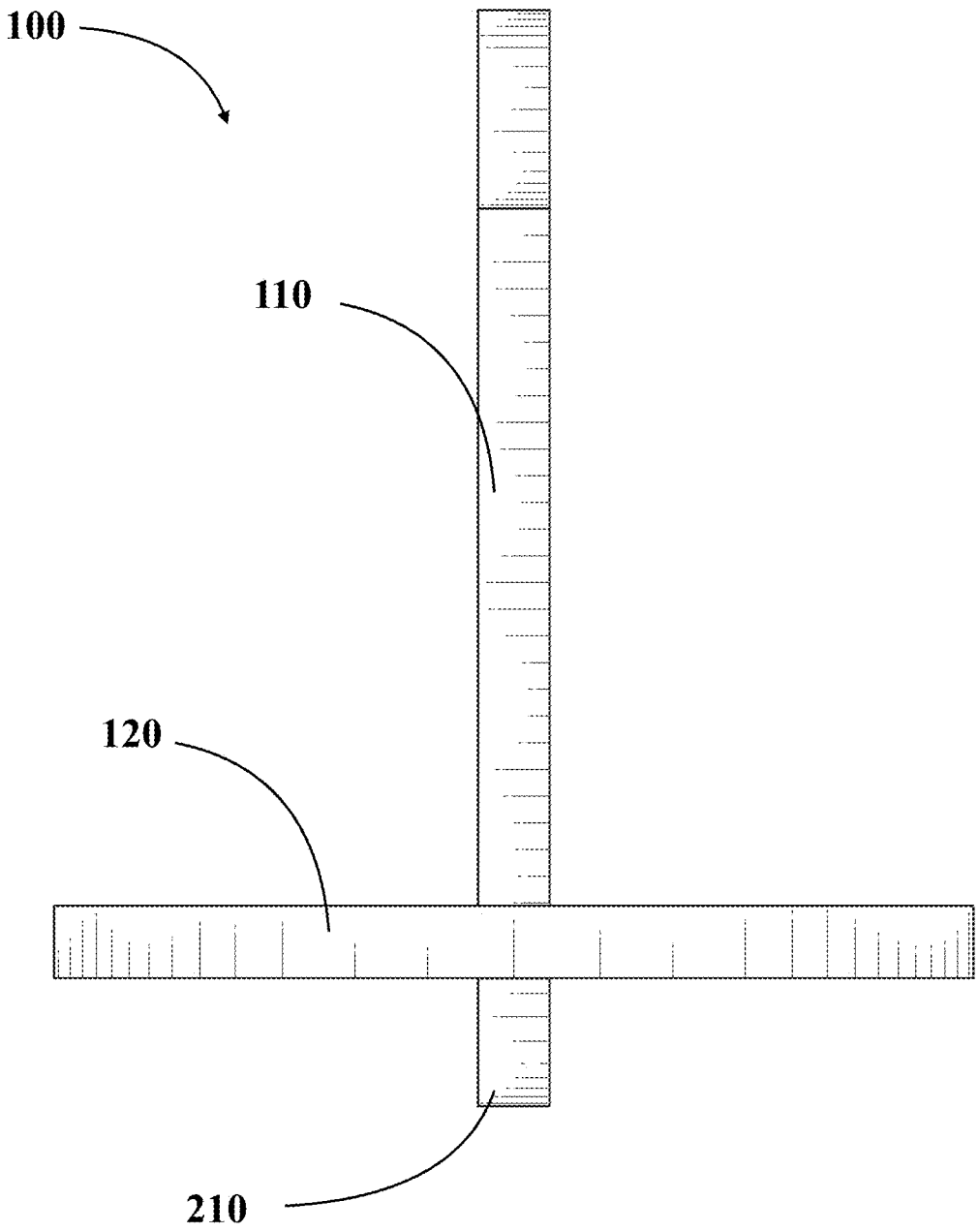
FIG. 5 is a side view of a yarn minder apparatus in accordance with a preferred exemplary embodiment of the present invention.

Referring now to FIG. 5, a side view of a yarn minder apparatus in accordance with a preferred exemplary embodiment of the present invention is depicted. As shown in FIG. 5, distal end 201 of spindle 110 has been inserted through slot 310 and is supporting circular base 120. Circular base 120 is, in turn, supporting any yarn 205 that that been wrapped around spindle 110.

Figure 6:
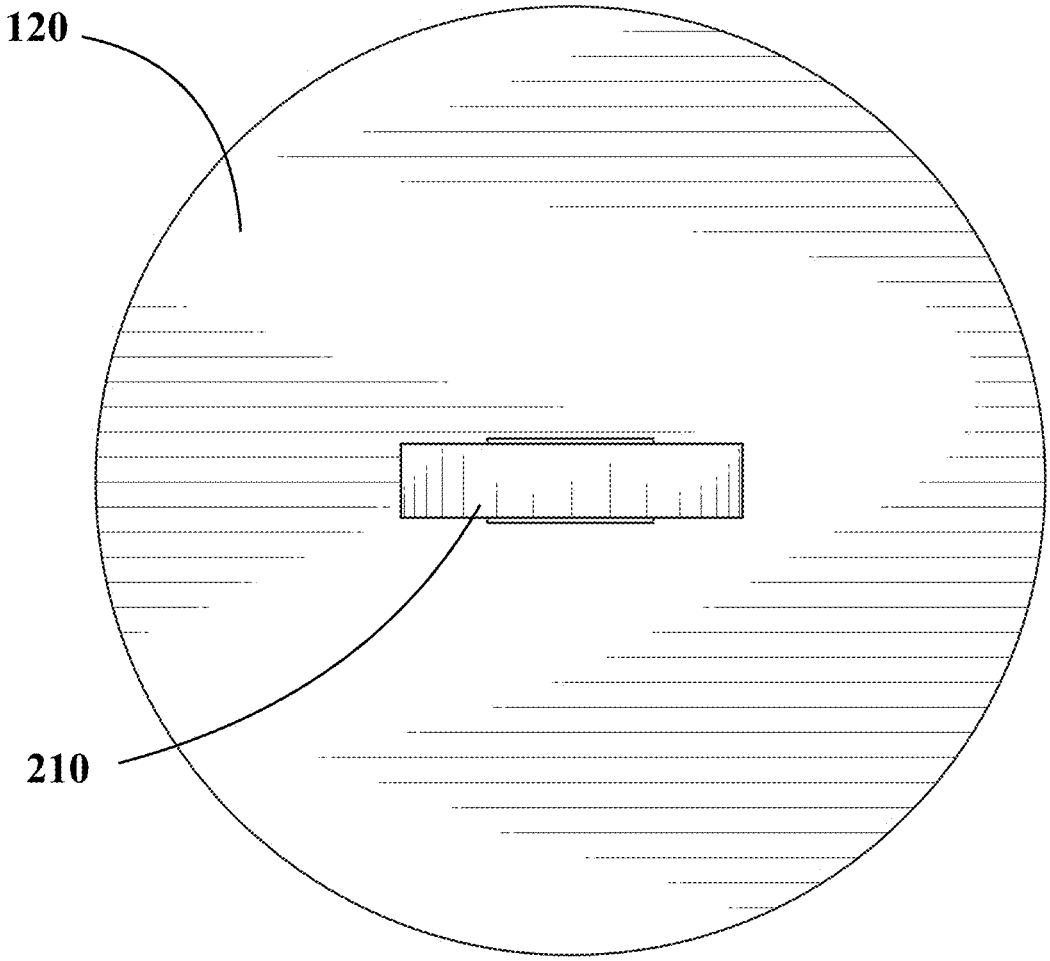
FIG. 6 is a bottom view of a yarn minder apparatus in accordance with a preferred exemplary embodiment of the present invention.

Referring now to FIG. 6, a bottom view of a yarn minder apparatus in accordance with a preferred exemplary embodiment of the present invention is depicted. As shown in FIG. 6, distal end 201 of spindle 110 has been inserted through slot 310 and is supporting circular base 120. Circular base 120 is, in turn, supporting any yarn 205 that that been wrapped around spindle 110.

In practice, the method of using yarn minder 110 is straightforward. Spindle 110 is rotated and then inserted through slot 310 of circular base 120. Once inserted into position, spindle 110 is rotated again and arms 310 are then positioned to support circular base 120. Yarn 205 is then wound around spindle 110 where it can be dispensed. Additionally, a crafter may use a strap 230 that is connected to spindle 110 by connector 220 to support yarn minder 100 during the crafting process. Since connector 220 is a swivel connector, yarn minder 110 can rotate freely to prevent tangling of yarn 205.

One skilled in the art will appreciate that many variations are possible within the scope of the claims. Thus, while the disclosure or certain preferred embodiments of the present invention are particularly shown and described above, it will be understood by those skilled in the art that these and other changes in form and details may be made therein without departing from the spirit and scope of the claims.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Recitation of numerical ranges of values herein, if any, is merely intended to serve as a shorthand method of referring individually to each separate numerical value falling within the range. Unless otherwise indicated herein, each individual value of a numerical range is incorporated into the present specification as if it were individually recited herein.

The terms "a," "an," "the" and similar referents used in the context of describing the disclosed embodiments (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as"), provided herein is intended merely to better illuminate the present disclosure and does not pose a limitation on the scope of the embodiments otherwise claimed. No language in the present specification should be construed as indicating any non-claimed element essential to the practice of the disclosed embodiments of the present invention.

The invention claimed is:

1. An apparatus comprising:

a substantially flat, disc-shaped base, the base comprising a slot;

a spindle, the spindle having a flat, planar cross-sectional shape extending upwardly from the base, wherein the flat planar shape of the spindle is configured to receive and support a yarn ball wound thereon the spindle comprising:

a head;

a shaft; and two laterally spaced arms;

wherein the head of the spindle is inserted through the slot in the base, with the two arms supporting the base, thereby connecting the spindle to the base without the use of threaded fasteners.

2. The apparatus of claim 1 wherein the head comprises an aperture and further comprising:

a connector inserted through the aperture; and a strap affixed to the connector.

3. The apparatus of claim 2 wherein the strap comprises a strap manufactured from leather.

4. The apparatus of claim 2 wherein the strap comprises a strap manufactured from plastic.

5. The apparatus of claim 2 wherein the connector comprises a swivel connector.

6. The apparatus of claim 1 further comprising yarn wrapped around the spindle.

7. A method of managing yarn, the method comprising the steps of:

providing a substantially flat, disc-shaped base, the base comprising a slot;

providing a spindle, the spindle having a flat, planar cross-sectional shape extending upwardly from the base, wherein the flat planar shape of the spindle is configured to receive and support a yarn ball wound thereon, the spindle comprising:

a head;

a shaft; and a distal end, the distal end comprising a pair of laterally spaced arms, and inserting the head of the spindle through the slot in the base, thereby supporting the base on laterally spaced arms without the use of threaded fasteners.

8. The method of claim 7 wherein the head comprises an aperture.

9. The method of claim 8 further comprising the steps of:

attaching a connector to the head of the spindle via the aperture; and attaching a strap to the connector.

10. A yarn holder device, comprising:

a base having a substantially flat, disc-shaped body, the body comprising a slot;

a spindle having a flat, planar cross-sectional shape extending upwardly from the base, the spindle comprising two laterally spaced arms, wherein the flat planar shape of the spindle is configured to receive and support a yarn ball wound thereon; and a head element at an end of the spindle, the head element comprising an aperture extending therethrough, wherein the two arms of the spindle engage the base by extending through the slot in the base and are secured to the base without the use of threaded fasteners.

11. The yarn holder device of claim 10, further comprising a connector inserted through the aperture of the head element, and a strap affixed to the connector, wherein the strap comprises at least one of nylon webbing, leather, or polypropylene webbing.

12. The yarn holder device of claim 11, wherein the strap is a wrist strap configured to be worn around a user's wrist.

13. The yarn holder device of claim 11, wherein the connector is a swivel connector configured to permit rotational movement of the strap relative to the head element.

14. The yarn holder device of claim 11, wherein the strap and connector assembly is detachably connected to the aperture of the head element.

15. The yarn holder device of claim 10, wherein the spindle is configured to have yarn wrapped directly around the flat planar body of the spindle between the two arms.

* * * * *